United States Patent [19]
Repetto

[11] 4,267,714
[45] May 19, 1981

[54] HYDRAULIC DEVICE FOR PRODUCING A TO-AND-FRO MOVEMENT

[75] Inventor: Silvio Repetto, Modena, Italy

[73] Assignee: S.p.A. Luigi Rizzi & C., Modena, Italy

[21] Appl. No.: 922,842

[22] Filed: Jul. 7, 1978

[30] Foreign Application Priority Data

Sep. 15, 1977 [IT] Italy ..... 27585 A/77

[51] Int. Cl.[2] ..... C14B 1/06
[52] U.S. Cl. ..... 69/32
[58] Field of Search ..... 69/8, 23, 27, 32, 43

[56] References Cited

U.S. PATENT DOCUMENTS 1,053,297 2/1913 Kehnhahn ..... 69/32
2,404,873 7/1946 Winkley ..... 69/43
3,762,190 10/1973 Ruffer et al. ..... 69/32
3,910,077 10/1975 Kessler ..... 69/32

*Primary Examiner*—Patrick D. Lawson
*Attorney, Agent, or Firm*—Kurt Kelman

[57] ABSTRACT

A hydraulic device for producing a to-and-fro movement of a lever connected to a double-acting piston/cylinder unit comprises a pressure fluid distributor including a control piston for alternately feeding pressure fluid to one or the other side of the piston in the unit to move the lever alternately in opposite directions. A hydraulically actuatable control device for controlling the distributor includes a reciprocable piston member movable in a cylinder and a motion transmitting member in contact with the control piston of the distributor to transmit motion thereto. The piston member has a central large diameter section between two reduced diameter sections and the motion transmitting member is in contact with the surface of the piston member so as to reciprocate transversely in the cylinder when the piston member moves relative to the motion transmitting member between two end positions. The control device also includes an independently actuatable single-acting piston movable into a position where it holds the piston member with its large diameter section registering with the motion transmitting member.

7 Claims, 3 Drawing Figures

HYDRAULIC DEVICE FOR PRODUCING A TO-AND-FRO MOVEMENT

Figure 1:
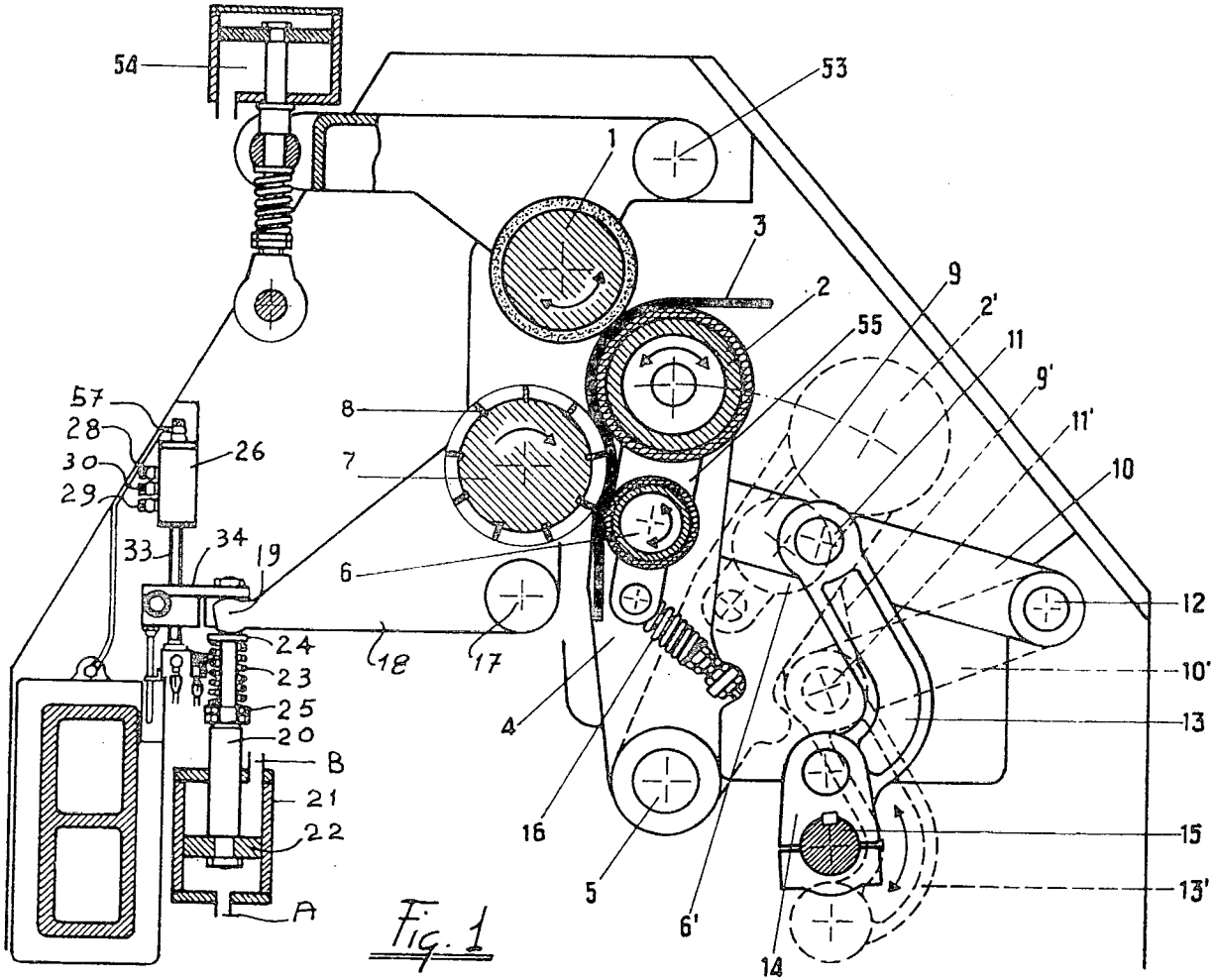

The present invention relates to a hydraulic device for producing a to-and-fro movement, and which is applicable to machines for processing skins or the like, particularly for moving the stretching roller close to and away from skin drawing rollers both during the reversal of the direction of rotation of the rollers and upon stopping the rollers.

As known, the stretching operation and simultaneous squeezing of skins, i.e. the operation by means of which a skin is drawn or stretched, is carried out by means of machines which generally comprise:

a squeeze roller covered with felt or another suitable absorbing material, two drawing rollers and two backing rollers coated with rubber or the like, a stretching roller provided with preferably continuous, radially extending, equidistant ahd helically or spirally extending blades. In general, the stretching rollers have a helix wound in one direction over half the length of the roller and an identical helix wound in the opposite direction over the other half of the roller. In this arrangement the skin is processed between two rubber drawing rollers and two rubber backing rollers, on the one hand, and the stretching roller on the other hand, and is continuously subjected to the stretching action in the axial direction of the two series of helical blades being wound in opposite directions.

The stretching operation requires in practice several passes (forwards and backwards) of the skins between the rollers and this is achieved by pre-setting the machine in such a way that the drawing rollers may reverse their direction of rotation with respect to that of the stretching roller, so that the skin is fed several times between the stretching roller, the drawing rollers and the backing rollers, thereby obtaining a desired stretching and squeezing effect.

Furthermore, to permit the skin to be fed to and extracted from between the drawing rollers and the stretching roller, the machine is provided with devices for moving the rubber roller and the pressure roller away from (and near to) the stretching roller.

The machines equipped in this way for stretching skins thus require that, to perform the various passes of the skin between the rollers, the drawing rollers are momentarily stopped several times and caused to rotate again in the opposite direction upon each reversal of the direction of rotation, and thus the drawing rollers stop for a few instants while the stretching roller goes on rotating.

Furthermore, each time the machine is opened (for inserting successive skins between the rollers), the drawing rollers are stopped while the stretching roller continues rotating. In operation, upon each reversal of the direction of rotation of the drawing rollers and upon closing the machine, the stretching roller comes into contact with the skin which is stationary and forms on it a mark or luster line which is very detrimental to the full utilization of the skin, because it is visible even at the end of the skin processing, the line practically extending over the entire width of the skin.

The present invention provides a hydraulic device for actuating, by way of a pressure fluid distributer, a double-acting piston arranged to move a first member to-and-fro, the device comprising a hydraulic unit having a cylinder in which a double-acting piston is slidably mounted, the piston including two opposite pistons rigidly connected to each other by a substantially biconical piston rod having a maximum conicity at the middle of its length, a control rod in contact with the biconical piston rod and being mobile transversely of the cylinder, the free end of the control rod controlling by contact the pressure fluid distributer control member during its strokes from a position of maximum displacement when the maximum conicity of the piston rod is in its central position, to a position retracted in the cylinder, always in contact with the piston rod when the piston rod is laterally displaced, so that when the said control rod is displaced to a maximum extent, fluid under pressure is supplied from the distributor to the said double-acting cylinder, thereby controlling the first member to be moved.

The device set forth can be incorporated in a machine for stretching and squeezing skins, the machine having a stretching roller mounted on the first member of the device so as to be movable towards and away from drawing rollers and backing rollers during reversal of the machine and upon opening of the machine.

At the two opposite smaller conicities of the piston rod, the lever takes the most retracted position, and fluid under pressure is supplied to the opposite end of the control cylinder, so that the latter can control the closing movement of the stretching cylinder towards the drawing rollers.

At the opposite ends of the cylinder having a biconical piston rod, ports are provided for supplying fluid under pressure by a control operated by an attendant simultaneously with a control for reversing the direction of rotation of the drawing rollers, so as to cause, upon each pass of the maximum conicity beneath the mobile control rod, the stretching roller to be moved away from the drawing rollers. When either smaller conicity in the biconical piston rod is located underneath the mobile control rod, the stretching roller is moved close and kept in that position throughout the processing time until the direction of rotation is reversed again. To move the stretching cylinder away when the machine is opened by removing the drawing rollers, a further cylinder is provided co-axial with the double-acting cylinder, the further cylinder having a single-acting piston with a predetermined maximum stroke, the single-acting piston being adapted to control the double-acting piston to bring the maximum conicity of the biconical piston rod into contact with the mobile control rod and then to move the stretching roller away by supplying pressure fluid thereto upon opening or separating the drawing rollers.

Figure 2:
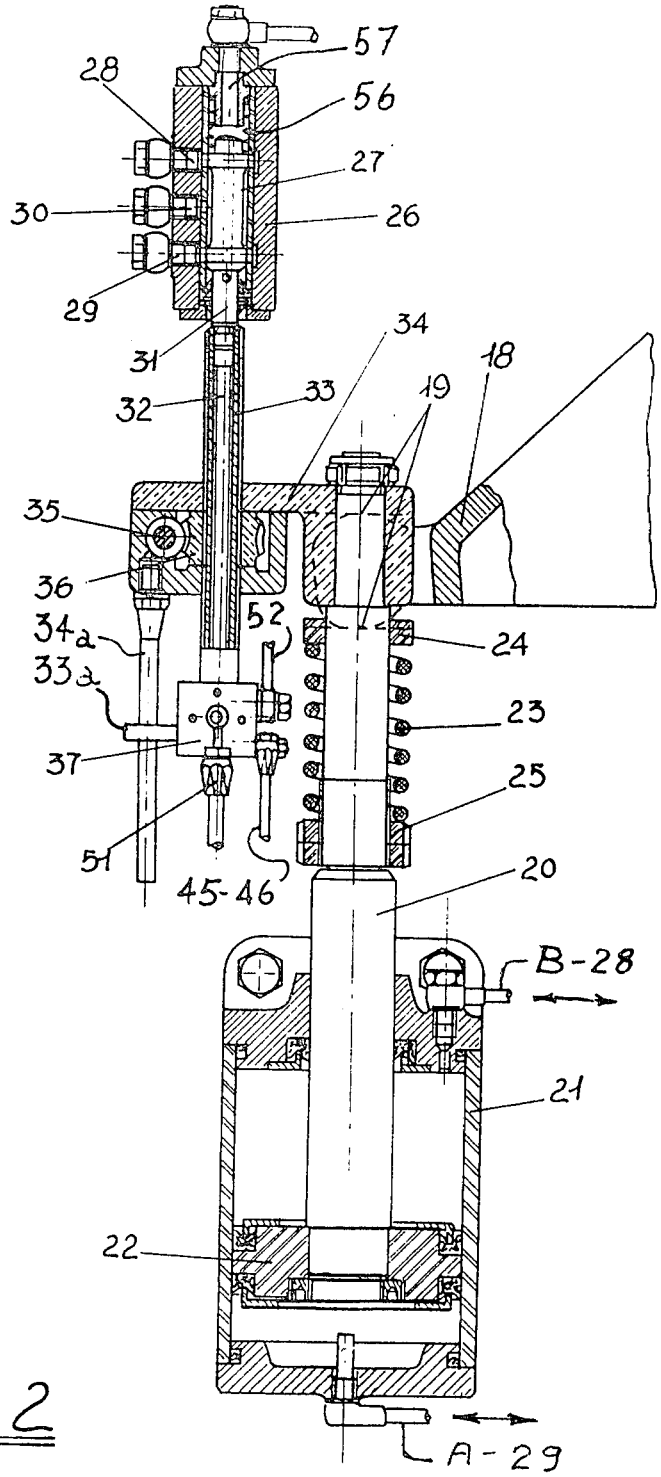
Figure 3:
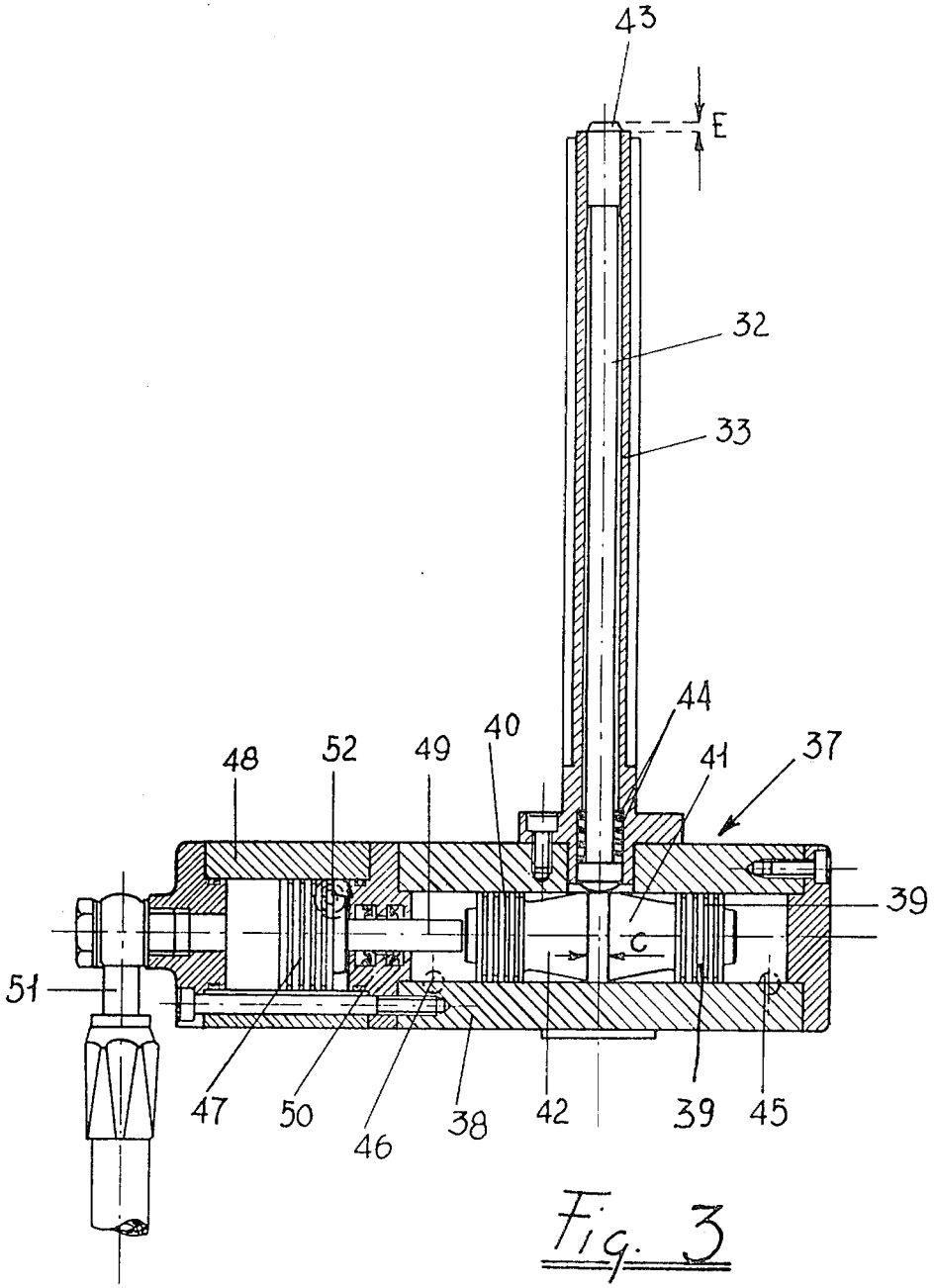

The invention will be described in more detail below, by way of example, with reference to the accompanying drawings, in which:

FIG. 1 diagrammatically illustrates components of a conventional machine for stretching or extending and/or squeezing skins or the like, to which the apparatus in accordance with the invention is applicable;

FIG. 2 is a cross-sectional view of a hydraulic unit of known type for effecting the separation of the stretching roller from the drawing rollers in the machine of FIG. 1 incorporating the apparatus in accordance with the invention; and FIG. 3 shows a diametral cross-sectional view, on a much enlarged scale, of the hydraulic apparatus in accordance with the invention.

The known machine shown in FIGS. 1 and 2 has a squeeze roller 1 and a drawing roller 2 arranged to draw a skin 3 to be stretched (or extended) and to be dried.

The squeeze roller 1 is preferably coated with felt or other absorbing material and is motor-driven. The roller 1 besides being arranged to draw the skin also has the function of drying it by squeezing. To this end, the roller 1 is supported by levers (one on each side) pivotable about a pivot axis 53, and can exert a thrust onto the skin trained around the roller 2 when the machine is closed. The thrust is provided by two hydraulic pistons 54 or other suitable known equivalent means one of which is illustrated in FIG. 1, its operation being self-explanatory.

The drawing roller 2 which is also motor-driven is covered with rubber or the like and is mounted for rotation on levers 4 pivoted about an axis 5, the said levers 4 being arranged at the two ends of the roller itself.

A backing roller 6 is carried by two levers 55, one at each end, which may oscillate about the axis of the roller 2. The other end of the lever 55 is connected to the levers 4 by way of a resilient connection 16 (springs or the like).

When the machine is closed, a stretching roller 7 of conventional type rotates in contact with the rollers 2 and 6, the outer cylindrical surface of the roller 7 being provided with helical blades (which extend in one direction on one half of the roller 7 and in the opposite direction on the other half of the roller). The levers 4 and rollers 2 and 6 may be moved away or separated from the roller 7 by means of levers 9, 10, the levers being linked to one another at 11, the other ends of levers 9 being articulated to the levers 4 and those of levers 10 to a fixed point 12.

A further curved lever 13 has one end articulated at 11 to levers 9, 10 and its other end is pivoted to a crank 14 rigid with a driving shaft 15.

Rotation through 180° of the driving shaft 15 and the crank 14 causes, by way of curved lever 13, a toggle movement of the levers 9 and 10 (position indicated by dashed lines 13', 10' and 11'), and thus the pivotal movement of the levers 4 thereby causing the rollers 2 and 6 to move away from the stretching roller 7.

A spring 16 allows the roller 6 to move away from the stretching roller 7 if the skin fed therebetween has folds or pleats, clots of fat or some considerable variation in thickness.

The rollers 1, 2 and 6 are connected to one another by a mechanical transmission comprising sprocket wheels and chains (not shown) and are rotated by a single hydraulic motor. The shaft 15 which controls the opening and closing of the machine is also rotated hydraulically.

The hydraulic motor controlling the rotation of the rollers 1, 2 and 6 may turn the rollers in either direction, and thus an attendant can reverse, by means of a control pedal and conventional means, the direction of rotation of the rollers each time the skin has effected a first pass so as to allow the stretching roller 7 to carry out successive stretching operations on the skin. The rotation of the shaft 15 is also controlled by the attendant by means of conventional pedal control electro-hydraulic means.

The stretching roller 7 is mounted for rotation together with its own motor on a frame pivoting about a fixed axis 17, the frame having two end levers 18 of triangular or L-shaped configuration, which are pivoted or linked at 19 to the end of a piston rod 20 of a cylinder 21 enclosing a double-acting piston 22 (FIGS. 1 and 2).

A helical spring 23 coaxial with the piston rod 20 and placed between an abutment 25 rigid with the piston rod 20 and an abutment 24 sliding on the piston rod 20 urges the ends 19 of the support levers of the stretching roller 7 against an abutment 34 rigid with the piston rod 20. In this way, the stretching roller 7 is held in position by hydraulic piston 22 but may be moved away from the rollers 2 and 6 owing to the resilient action of the spring 23 when the skin between the said rollers has large and unforeseen thickness variations. At the opposite ends of the cylinder 21 two ports B and A are provided through which fluid under pressure is alternately fed. The feed of fluid is controlled by a distributor 26 which, as will be better explained below, is a four-way distributing valve (FIG. 2). This distributor comprises a cylinder in which a spool or piston 27 with a seal at each end is slidably mounted. The cylinder is formed with two inlet ports 28 and 29 with a distance between them which is the same as the distance between the seals, with an inlet port 30 arranged centrally for fluid under pressure from a separate source, not shown, and with an outlet port 57 coaxial with the cylinder. The piston 27 is urged downwards by a spring 56.

The port 28 is connected to the port B of the cylinder 21 and the port 29 is connected to the part A of the same cylinder 21. The double-acting piston 27 has its piston rod 31 in contact with the end of a mobile control rod 32 guided within a sleeve 33. The lower end of the sleeve 33 is connected to a hydraulic apparatus 37, shown on an enlarged scale in FIG. 3 for clarity. The sleeve 33 is externally screw-threaded and is adjustably fixed in abutment plate 34 secured to the end of the piston rod 20 of the piston 22 and cooperating with the end 19 of the lever 18. The upper end of the sleeve 33 abuts against the piston rod 31 of the piston 27 and forms a resting base for the piston rod 31 in the normal working position. The position of the plate 34 on sleeve 33 is previously adjusted so as to obtain a desired distance between the stretching roller and the drawing rollers. The adjustment is effected by means of a worm gear 35 and a toothed, internally threaded wheel 36 meshing with the thread of the sleeve 33. An extension **33*a* slidable on a control rod 34*a* permits the sleeve 33 to be axially moved but prevents it from rotating. The hydraulic apparatus 37 has the function of moving the stretching roller 7 away from the rollers 2 and 6 by acting on the levers 18 by way of the distributor 26 and the control cylinder 21. It substantially comprises an elongate cylinder 38 (FIG. 3) in which a double-acting piston is slidably mounted. The double-acting piston has two opposite pistons 39 and 40 connected to each other by a piston rod having two opposite conicities, i.e. a conical piston rod 41 and a conical piston rod 42 connected to each other at their larger ends by means of a cylindrical portion C so as to slide inside the cylinder 38. The body of the cylinder 38 is formed with an opening through which the lower end of the mobile control rod 32 passes to engage biconical piston rod 41, 42. In FIG. 3, the rod 32 rests on the cylindrical portion C (largest conicity) of the biconical piston rod. The guide sleeve 33 is coaxially fixed in the opening and the rod 32 has a length so as to allow, when the rod is in the lifted position in contact with the portion C as indicated in FIG. 3, projection of its upper end 43 with respect to the free end of the sleeve 33 by a length E sufficient to actuate, as will be explained below, the piston rod 31** of the piston 27 mobile within the distributor 26. Each movement of the biconical piston rod to the left or to the right results in the rod 32, which is urged by the return spring 44, being lowered by following the decreasing conicity of the surface in either direction until it is completely within the end of the sleeve 33. Thus, when the end 43 of the rod 32 emerges from the end of the sleeve 33, the piston 27 of the distributor 26 is moved upwards.

At the two opposite ends of the cylindrical body 38 two ports 45 and 46 are provided, and fluid under pressure is supplied through one or other of these ports to actuate the piston in the two opposite directions. The port 45 communicates with a branch of the supply circuit of the hydraulic motor of the drawing rollers which controls rotation of the rollers in one direction (the direction in which the skin is extracted) and the port 46 is connected to ducts arranged to supply the motor with fluid to control rotation in the opposite direction (the direction in which the skin is introduced into the machine). With this hydraulic connection, each time the direction of rotation of the motor controlling the drawing rollers is reversed by intervention of the attendant, the supply of the fluid under pressure is automatically switched from one inlet port to the other. In other words, upon reversing the direction of movement, the piston with biconical piston rod 41, 42 is displaced from one end to the other of the cylinder 38, so that end 43 of rod 32 reaches its most retracted position within the cylinder, after passing through the most outwardly projecting position.

The apparatus also comprises a single acting piston 47 slidably mounted within a cylinder 48 coaxial with the cylinder 38 and rigid with a piston rod 49 which is guided within a sealing element 50. The length of the rod 49 is such that when the piston 47 is at its dead point against the element 50 (as shown in FIG. 3), its end is in contact with the piston 40 and the cylindrical portion C of the biconical piston rod is precisely beneath the mobile rod 32. The cylinder 48 is connected by way of a duct 51 to the pressure fluid duct which controls, upon intervention of the attendant, the opening or separation movement of the drawing rollers. With this arrangement, upon opening or separating the rollers to introduce a skin, control fluid is simultaneously sent to the cylinder 48 to displace the piston 47 to the end of its stroke. Consequently, the rod 32 is lifted to raise piston 27 so that ducts 30 and 28 are in communication and fluid is supplied to the cylinder 21 via the duct 28 and the port B, thereby lowering the piston 22 and thus moving the stretching roller 7 away from the drawing rollers 2, 6. The cylinder 48 also has a port 52 which is permanently connected to an outlet.

The operation of the apparatus described is as follows:

Assume that initially the machine is in operation with its stretching roller 7 rotating and its drawing rollers 2 and 6 in an open position and then stops, which in practice corresponds to the operation of inserting a skin to be stretched.

At this point, as already mentioned above, there is pressure at 51, and thus hydraulic apparatus 37 is in the position shown in FIG. 3 where it effectively holds the stretching roller, which is rotating, in a position remote from the working position with respect to the drawing rollers because the rod 32 is lifted by the portion C of the piston rod 41, 42 and has its end 43 projecting a length E from the sleeve 33 so that it lifts the piston 27 to uncover the port 28 of the distributor 26, thereby supplying fluid to the cylinder 21 through the upper port B, which causes the piston 22 to lower. Oil coming out from port A passes through the port 29 and reaches the outlet 57. The piston 22, and its piston rod 20, lower abutment plate 34 acting on the end 19.

This movement causes the lever 18 to pivot and to move the stretching roller 7 away from the drawing rollers 2, 6. The extent of this movement strictly depends on the length E by which the end 43 of the rod 32 projects from the sleeve 33 because, since the piston 27 urged by the spring 56 is constantly in contact with the sleeve 33 and the latter is rigid with the plate 34 which in turn is movable with the end 19 of the lever 18, the stable position held by the piston 22 of the stretching roller by means of the piston itself and the lever 18 is the position in which the piston 27 of the distributor 26 closes both ports 28 and 29.

Consequently, when the end 43 of the rod 32 projects by an amount E, the lever 18 is lowered to the same extent since this movement also lowers the sleeve 33 and the rod 32 by a length E, thereby moving the piston 27 to close the ports 28, 29. This lowering movement is sufficient to prevent the stretching roller 7 from coming into contact with the skin to be processed. Once the skin has been introduced the rollers are controlled by means of a pedal to move closer and the hydraulic motor rotates the drawing rollers 2, 6 in the direction of extraction of the skin. At the same time, upon starting the motor, fluid under pressure is supplied by way of the port 45 to the portion on the right hand side of the cylinder 28, thereby moving the biconical piston to the left because pressure is simultaneously removed from the port 51 (during which period the machine is closed). This movement of the biconical piston causes the rod 32 to be lowered while following the inclination of the cone 41 thereby uncovering the port 29 of the distributor, and thus fluid under pressure flows through A into the control cylinder 21 (oil from B reaches the outlet 57 through 28). The piston 22 while being lifted moves the stretching roller 7 to a closed position where the stable condition provided by closure of the ports 28, 29 by the piston 27 is attained.

After the first pass of the skin, the direction of rotation of the rollers 2 and 6 is reversed by actuating a pedal. During the reversal, the motor is stopped for a moment and fluid is supplied in the opposite direction through the port 46 of the cylinder 38 containing the biconical piston. The piston is moved to the right, and the portion C of greatest conicity passes beneath the rod 32. The rod 32 is thus lifted, which results in fluid under pressure being supplied from the port 28 to the port B of the cylinder 21 which moves the stretching roller 7 away from the drawing rollers for a time interval during which the movement of the skin is stopped. The biconical piston moves on to bring its portion with least conicity under the rod 32 which is thus lowered, thereby moving the stretching roller against the drawing rollers again. At this point however the hydraulic motor has already started rotating in the opposite direction and the skin is worked until the next reversal which is effected by the apparatus 37 as described above, i.e. by supplying fluid under pressure to the cylinder 38 by way of the port 45. After a predetermined number of reversals, fluid is supplied to the conduit 51 while the rollers are separated or moved apart. The piston 47 then moves the biconical piston to the middle and thus the rod 32 is lifted to cause the stretching roller to be moved away.

The skin may then be extracted without damage.

What we claim is:

1. A hydraulic device for producing a to-and-fro movement of a first member, the device comprising a double-acting piston-cylinder unit to which the first member is connected, a pressure fluid distributor including a control member for alternately feeding pressure fluid to one side or to the other side of the piston in the piston/cylinder unit to move the first member alternately in opposite directions, and a hydraulically actuable control device for controlling the distributor, the control device including a cylinder, a reciprocable piston member movable in the cylinder and a motion transmitting member, the piston member having a central large diameter section between two reduced diameter sections, and the motion transmitting member being in contact with the surface of the piston member so as to move transversely of the cylinder first in one direction and then in the opposite direction when the piston member moves relative to the motion transmitting member between two end positions, the motion transmitting member also being in contact with the control member of the distributor to transmit motion thereto, the control device also including an independently actuable single-acting piston movable into a position where it holds the piston member with its large diameter section registering with the motion transmitting member.

2. The hydraulic device of claim 1, wherein the reduced diameter piston member sections are two truncated cones joined at their large ends and the central piston member section is a cylindrical joining portion between the large ends of the cones providing a rest for an end of the motion transmitting member.

3. The hydraulic device of claim 1, wherein the motion transmitting member is an axially movable rod and comprises a return spring urging the rod against the surface of the piston member.

4. The hydraulic device of claim 1, further comprising an addition cylinder coaxial with the cylinder wherein the reciprocable pistion member is movable, and the independently actuable single-acting piston is arranged in the additional cylinder and has a central control rod arranged to engage an end of the reciprocable piston member for moving the piston member into a central position.

5. A machine for stretching and squeezing skins, comprising cooperating drawing, squeezing and stretching rollers, the drawing and squeezing rollers being movable into cooperation with each other and rotatable in opposite directions for moving the skins in opposite directions and for squeezing the skins, and the stretching roller being mounted for to-and-from movement towards and away from the drawing roller, the stretching roller being connected to the first member of the hydraulic device of claim 1.

6. The machine of claim 5, wherein the motion transmitting member is arranged to produce the fro movement of the first member for moving the stretching roller away from the drawing roller when the motion transmitting member is in contact with the large diameter section of the piston member.

7. The machine of claim 5, wherein the motion transmitting member is an axially movable rod having a stroke proportional to the extent to which the stretching roller is to be moved away from the skin while the squeezing and drawing rollers are stationary, and a return spring is arranged to urge the rod against the surface of the piston member.

* * * * *